US008532520B2

(12) United States Patent
Hiramatsu

(10) Patent No.: US 8,532,520 B2
(45) Date of Patent: Sep. 10, 2013

(54) IMAGE FORMING APPARATUS HAVING CLEANING UNIT WITH COLLECTING MEMBER AND BIAS CONTROL

(75) Inventor: Hiroshige Hiramatsu, Inuyama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 358 days.

(21) Appl. No.: 13/050,911

(22) Filed: Mar. 17, 2011

(65) Prior Publication Data

US 2011/0229177 A1 Sep. 22, 2011

(30) Foreign Application Priority Data

Mar. 19, 2010 (JP) ..... 2010-063982

(51) Int. Cl.
*G03G 15/16* (2006.01)

(52) U.S. Cl.
USPC ..... 399/101

(58) Field of Classification Search
USPC ..... 399/66, 101, 347, 354, 357
See application file for complete search history.

(56) References Cited

U.S. PATENT DOCUMENTS 5,600,405 A * 2/1997 Umeda et al. ..... 399/71
7,389,061 B2 * 6/2008 Yamaki et al. ..... 399/44
7,444,098 B2 * 10/2008 Hamada et al. ..... 399/101
8,346,113 B2 * 1/2013 Shibuya et al. ..... 399/71
2001/0028817 A1 10/2001 Tamura et al.
2005/0180773 A1 8/2005 Morimoto et al.
2008/0031649 A1 2/2008 Dan

FOREIGN PATENT DOCUMENTS

JP 2001-005360 A 1/2001
JP 2001-282010 A 10/2001
JP 2005-077577 A 3/2005
JP 2005-249915 A 9/2005
JP 2006-058733 A 3/2006
JP 2007-218979 A 8/2007
JP 2008-039905 A 2/2008

* cited by examiner

*Primary Examiner* — Robert Beatty
(74) *Attorney, Agent, or Firm* — Baker Botts L.L.P.

(57) ABSTRACT

An endless belt circularly moves to convey a recording medium placed thereon in a conveying direction. A plurality of photosensitive bodies is juxtaposed in the conveying direction with confronting the endless belt. A plurality of process units supplies developer to the plurality of photosensitive bodies to form a developer image thereon, respectively. A first collecting member contacts the endless belt to collect the developer on the endless belt. A second collecting member is capable of collecting from the first collecting member the developer collected on the first collecting member. A control unit applies a bias between the first collecting member and the second collecting member to inhibit the developer collected on the first collecting member from being transferred to the second collecting member when the first collecting member rubs the endless belt with the toner collected on the first collecting member.

9 Claims, 9 Drawing Sheets

IMAGE FORMING APPARATUS HAVING CLEANING UNIT WITH COLLECTING MEMBER AND BIAS CONTROL

CROSS REFERENCE TO RELATED APPLICATION

This application claims priority from Japanese Patent Application No. 2010-063982 filed Mar. 19, 2010. The entire content of the priority applications is incorporated herein by reference.

TECHNICAL FIELD

The present invention relates to an image forming apparatus.

BACKGROUND

It has been well known a laser printer as a color image forming apparatus that is capable of forming a color image by electrophotographic method as disclosed in Japanese Patent Application Publication No. 2001-5360. For example, in a direct transfer type laser printer, an electrostatic latent image formed on a photosensitive body corresponding to respective colors is developed to form toner images by toner of the respective colors on a developing roller provided as a part of a developing device.

Then, a sheet is conveyed by an endless conveying belt to face and contact each photosensitive body and the toner images are transferred onto the sheet to form a color image thereon. Note that, a foreign matter such as toner adhering to the conveying belt is collected by a collecting member provided to confront the surface of the conveying belt at a position different from positions at which each photosensitive drum contacts the conveying belt.

SUMMARY

In the direct transfer type laser printer configured as described above, since the sheet is supported on the conveying belt to be conveyed, paper powder of the sheet adheres on the surface of the conveying belt when the sheet is conveyed. When the number of times of image forming operations increases, the conveying belt is covered by the accumulating paper powder to form a film. That is, a filming is occurred. With occurrence of filming by the paper powder, properties such as the electric resistance value of the surface of the conveying belt is changed to affect transferability for transferring the toner image from the photosensitive drums to the sheet. As a result, a print quality is adversely affected.

In view of the foregoing, it is an object of the present invention to provide an image forming apparatus capable of eliminating filming arising from the paper powder.

In order to attain the above and other objects, the present invention provides an image forming apparatus including an endless belt, a plurality of photosensitive bodies, a plurality of process units, a first collecting member, a second collecting member, and a control unit. The endless belt circularly moves to convey a recording medium placed thereon in a conveying direction. The plurality of photosensitive bodies is juxtaposed in the conveying direction with confronting the endless belt. The plurality of process units supplies developer to the plurality of photosensitive bodies to form a developer image thereon, respectively. The first collecting member contacts the endless belt to collect the developer on the endless belt. The second collecting member is capable of collecting from the first collecting member the developer collected on the first collecting member. The control unit applies a bias between the first collecting member and the second collecting member to inhibit the developer collected on the first collecting member from being transferred to the second collecting member when the first collecting member rubs the endless belt with the toner collected on the first collecting member.

BRIEF DESCRIPTION OF THE DRAWINGS

The particular features and advantages of the invention as well as other objects will become apparent from the following description taken in connection with the accompanying drawings, in which.

DETAILED DESCRIPTION

Entire Configuration and Image Forming Operation

An entire configuration of a color laser printer as an image forming apparatus will be described with reference to FIGS. 1 and 2, and an image forming operation performed on the color laser printer will be described with reference to FIG. 3.

Figure 1:
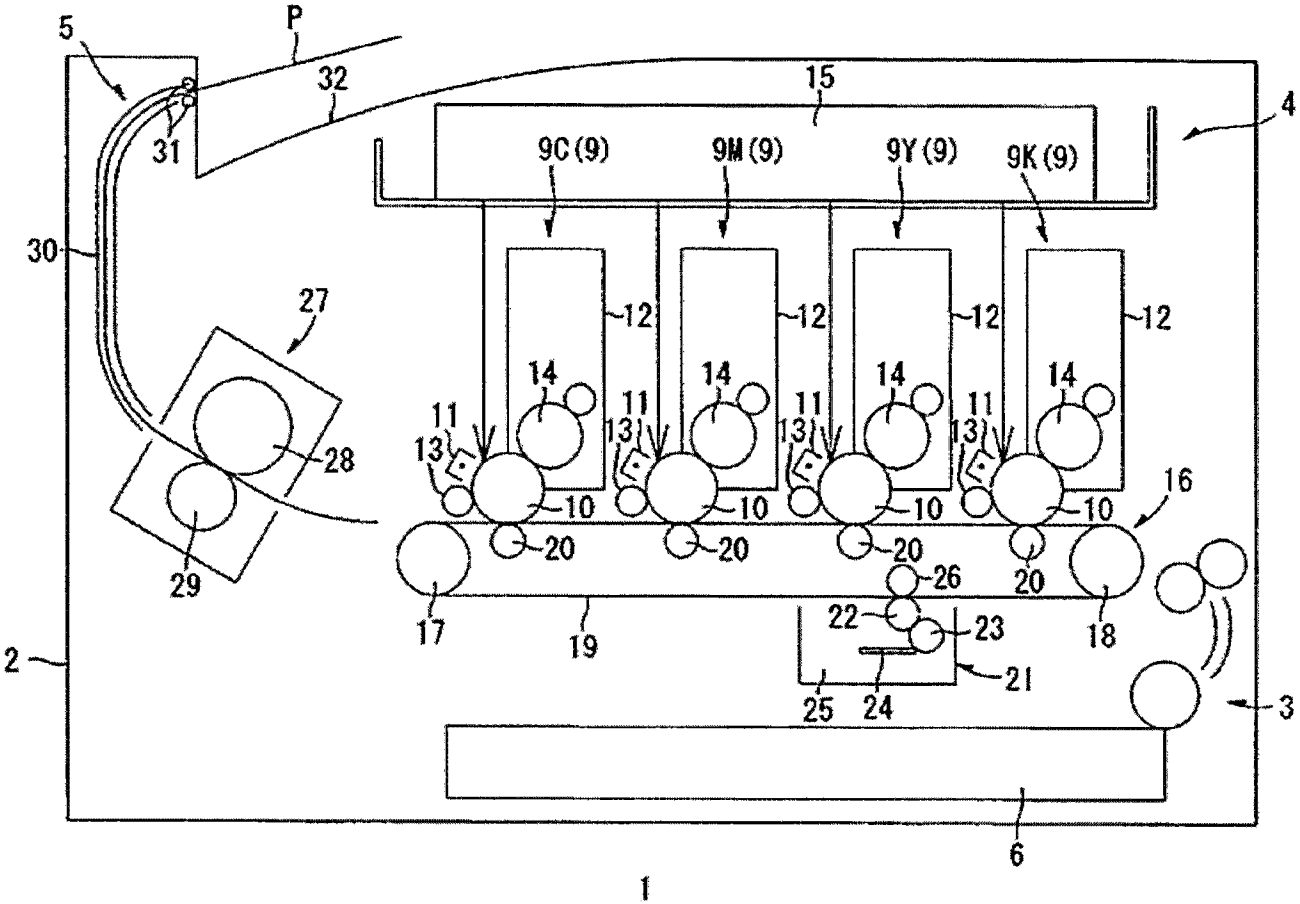
FIG. 1 is a schematic cross-sectional view showing a structure of a color laser printer according to an embodiment of the present invention.

The color laser printer 1 shown in FIG. 1 is a tandem type color laser printer. The color laser printer 1 includes a main body casing 2 formed in a box shape, and within the main body casing 2, a sheet convey unit 3 for conveying a sheet P as a recording sheet, an image forming unit 4 for forming an image on the sheet P, a fixing unit 27, and a discharge unit 5 for discharging the image fixed sheet P are provided.

Figure 2:
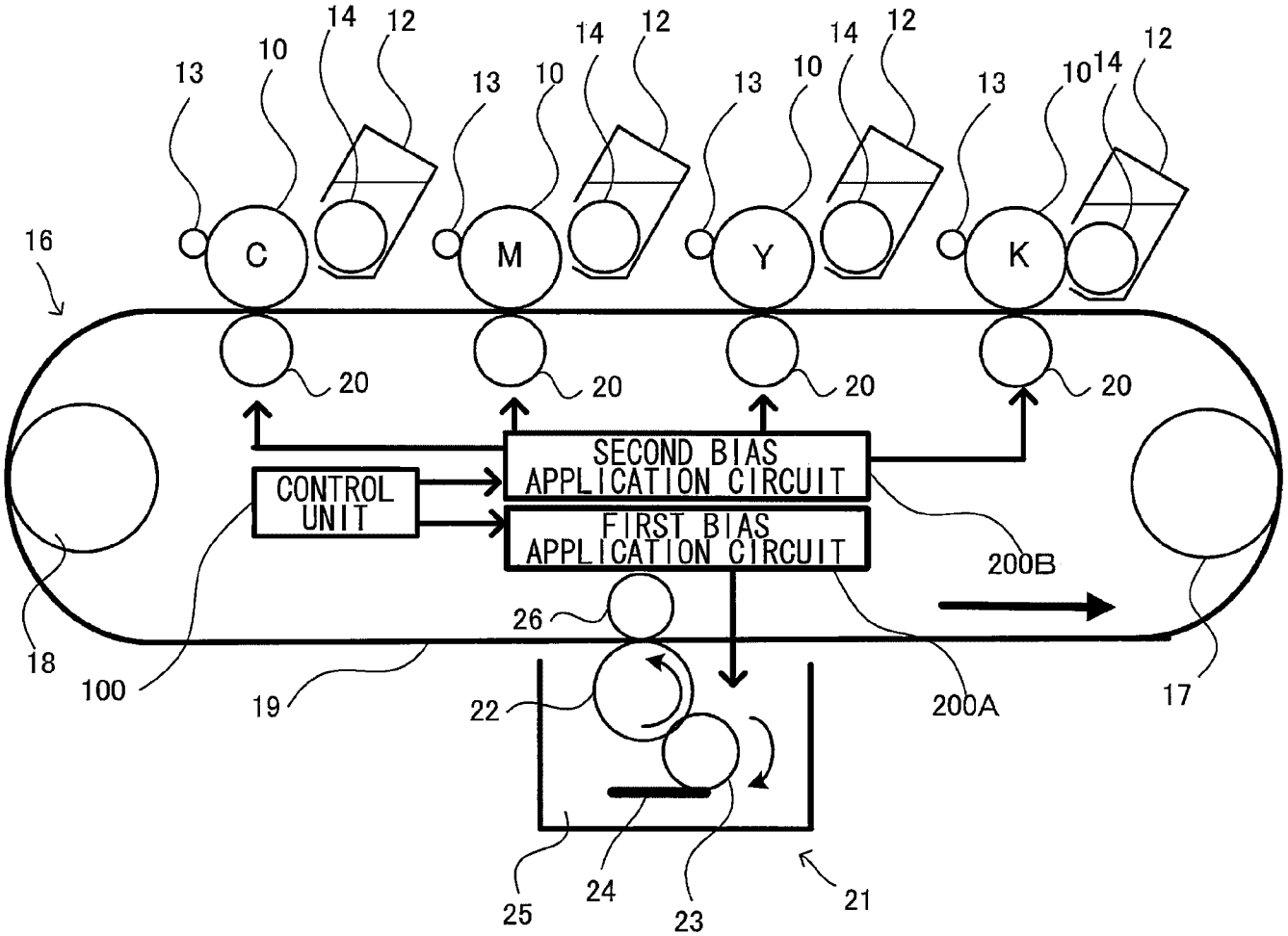
FIG. 2 is a schematic view showing a main section and an electrical structure for a process unit in the color laser printer shown in FIG. 1.

As shown in FIG. 2, the color laser printer 1 further includes a control unit 100. This control unit 100 is configured of a microcomputer including, for example, a CPU, a RAM, and a ROM. The control unit 100 controls each of units of the color laser printer 1 according to a program read from the ROM or the RAM as a memory area.

A first bias application circuit 200A and a second bias application circuit 200B provided in the main body casing 2 are connected to the control unit 100. Each of the bias application circuits 200A and 200B is configured of an electric circuit applying a bias to each unit of the color laser printer 1 according to commands of the control unit 100.

The first bias application circuit 200A is an electric circuit for applying a bias voltage to a first collecting roller 22 and a second collecting roller 23 described below. On the other hand, the second bias application circuit 200B is an electric circuit applying a bias voltage to various rollers and a holding roller 13 of the image forming unit 4.

The sheet convey unit 3 includes a sheet tray 6 for accommodating therein a stack of sheets P and various rollers for conveying one of the sheets P in the sheet tray 6 at a time. The sheet P fed from the sheet tray 6 is conveyed toward the image forming unit 4 by the various rollers.

The image forming unit 4 includes a plurality of process units 9, an exposure device 15, and a transfer unit 16. The plurality of process units 9 includes a black process unit 9K, a yellow process unit 9Y, a magenta process unit 9M, and a cyan process unit 9C arrayed in this order in a sheet conveying direction of the sheet P.

In the following description, if the black process unit 9K, the yellow process unit 9Y, the magenta process unit 9M, and the cyan process unit 9C do not need to be specially distinguished, these are referred to as "process unit 9".

Each process unit 9 includes a photosensitive drum 10, a charger 11, a developing device 12, and the holding roller 13.

The photosensitive drum 10 is a cylindrical shape. When the image is formed, the photosensitive drum 10 is driven to rotate in a predetermined direction (clockwise direction in FIGS. 1 and 2).

The charger 11 is, for example, a scorotron type charger of a positive charging type. The charger 11 includes a wire and a grid, and generates corona discharge by applying a charging bias.

The developing device 12 is positioned at the downstream side of the charger 11 in a rotational direction of the photosensitive drum 10. The developing device 12 is filled with positively charging, non-magnetic, single-component toner as a developer for each color, and includes a developing roller 14 for supplying the toner onto the surface of the photosensitive drum 10. The developing roller 14 has a circumferential surface in contact with the surface of the photosensitive drum 10. When the image is formed, a developing bias is applied to the developing roller 14 by the second bias application circuit 200B.

The holding roller 13 is located at the upstream side of the charger 11 in the rotational direction of the photosensitive drum 10. The holding roller 13 is positioned between the charger 11 and an endless conveyance belt 19 described below. The holding roller 13 has a circumferential surface in contact with the surface of the photosensitive drum 10.

As the photosensitive drum 10 rotates, the charger 11 applies a uniform positive polarity to the surface of the photosensitive drum 10. Subsequently, the exposure device 15 irradiates a laser beam onto the surface of the photosensitive drum 10 in a high-speed scan, thereby forming an electrostatic latent image which corresponds to an image to be formed on the sheet P, on the surface of the photosensitive drum 10. The electrostatic latent image on the photosensitive drum 10 is transformed into a visible image (a toner image) by supplying the toner from the developing roller 14.

The exposure device 15 may be configured of an LED array to be included in each of the process units 9 or may be located as a scanner unit including a light source and a polygon mirror above the image forming part 4.

The transfer unit 16 for transferring to the sheet P the toner image carried on the surface of each photosensitive drum 10 is provided below the process unit 9. The transfer unit 16 includes a drive roller 17, a follower roller 18, the conveying belt 19 wound around the drive roller 17 and the follower roller 18, and a metal roller 26 contacting the inner surface of the conveyance belt 19. The follower roller 18 is in confrontation with the drive roller 17 with a space, and positioned at the upstream side of the drive roller 17 in the sheet conveying direction of the sheet P. The conveying belt 19 has an upper section and a lower section.

The drive roller 17, the follower roller 18, and the conveying belt 19 are disposed such that a surface of the upper section of the conveyance belt 19 contacts the photosensitive drums 10 from below. The drive roller 17 is rotated in a direction opposite to the photosensitive drum 10 (counterclockwise direction in FIGS. 1 and 2) by a drive force from a motor (not shown). With rotation of the drive roller 17, the conveying belt 19 is circularly moved in the same direction as the drive roller 17, and the follower roller 18 is rotated. At this time, the metal roller 26 also follows movement of the conveying belt 19 to rotate.

Further, as shown in FIG. 2, the transfer unit 16 further includes four transfer rollers 20 positioned in confrontation with the photosensitive drums 10 interposing the conveying belt 19 therebetween and a cleaning unit 21 positioned in confrontation with the lower section of the conveyer belt 19 from below. A bias voltage is applied to the transfer roller 20 by the second bias application circuit 200B.

The cleaning unit 21 includes the first collecting roller 22, the second collecting roller 23, a urethane blade 24, and a retaining portion 25.

The first collecting roller 22 extends in the horizontal direction (the width direction of the conveying belt 19) orthogonal to a moving direction of the conveying belt 19, and has a circumferential surface in contact with the surface of the lower section (lower surface) of the conveying belt 19. The first collecting roller 22 is driven to rotate in the same direction (counterclockwise direction in FIGS. 1 and 2) as the moving direction of the conveying belt 19. Hence, the outer surface of the upper portion of the first collecting roller 22 moves in a direction opposite to the moving direction of the lower section of the conveying belt 19. When the conveying belt 19 is circularly moved and the first collecting roller 22 is rotated, the first collecting roller 22 is in slidingly contact with the conveying belt 19. The first collecting roller 22 is positioned in confrontation with the metal roller 26 via the conveying belt 19. In other words, the conveying belt 19 is nipped between the first collecting roller 22 and the metal roller 26.

The second collecting roller 23 extends parallel to the first collecting roller 22, and contacts the circumferential surface of the first collecting roller 22 with pressure. Further, the second collecting roller 23 rotates in a direction (clockwise direction in FIG. 2) opposite to the rotational direction of the first collecting roller 22.

The first bias application circuit 200A applies a collecting bias to the first collecting roller 22 and the second collecting roller 23. The potential differences are generated between the metal roller 26 and the first collecting roller 22 and between the first collecting roller 22 and the second collecting roller 23. By the potential difference between the metal roller 26 and the first collecting roller 22, a current flows between the metal roller 26 and the first collecting roller 22. The toner on the surface of the conveying belt 19 is transferred to the first collecting roller 22 at a nip position of the first collecting roller 22 and the metal roller 26 by the current flowing therebetween.

The fixing unit 27 is disposed downstream of the transfer unit 16 in the sheet conveying direction. The fixing unit 27 functions to fix a toner image formed on the surface of the sheet P to the sheet P. The fixing unit 27 includes a heating roller 28 and a pressure roller 29. The heating roller 28 is configured of a metal cylinder whose surface has been treated by a release agent, and a halogen lamp accommodated inside the cylinder. The heating roller 28 is driven to rotate by a driving force. The pressure roller 29 is a roller formed of silicon rubber that is rotatably supported in confrontation with the heating roller 28. The pressure roller 29 presses against the heating roller 28 with a pressure and follows the rotation of the heating roller 28.

The discharge unit 5 is disposed for discharging the sheet P out of the color laser printer 1 after the sheet P has passed through the fixing unit 27. The discharge unit 5 includes a sheet guide 30, and a pair of discharge rollers 31. The sheet guide 30 functions to guide the sheet P having passed through the fixing unit 27 to the discharge rollers 31. A discharge tray 32 is provided downstream of the fixing unit 27 and at an upper surface of the main body casing 2. Image fixed sheet P is discharged onto the discharge tray 32 by way of the sheet guide 30 and the discharge rollers 31.

Next, the image forming operation performed on the color laser printer 1 will be described. FIG. 3 is a timing chart of the image forming operation and a filming polish operation described later. The control unit 100 begins executing the image forming operation when the control unit 100 receives image data. At the beginning of the image forming operation, the sheet P is conveyed from the sheet convey unit 3 to the image forming unit 4. As shown in FIG. 3, the leading edge of the sheet P is supplied onto the conveying belt 19 and is conveyed so as to pass between the respective photosensitive drums 10 and the conveying belt 19 by the circular movement of the conveying belt 19.

On the other hand, the black process unit 9K positioned at the most upstream side in the sheet conveying direction develops the toner image on the photosensitive drum 10. Specifically, the control unit 100 applies 450V to each of the developing rollers 14. Each of the developing rollers 14 selectively provides the toner onto the corresponding photosensitive drum 10 by a potential difference between the photosensitive drum 10 and developing roller 14. Then, the toner image is formed on the photosensitive drum 10 of each process unit 9 in the order of yellow, magenta, and cyan.

Then, the conveying belt 19 on which the sheet P has placed is circularly moved such that the sheet P passes between the photosensitive drums 10 of the respective process units 9 and the conveying belt 19 in the order of black, yellow, magenta, and cyan. The toner image formed on each photosensitive drum 10 is sequentially superimposed onto the sheet P by a transfer bias applied to each of the transfer roller 20 while the sheet P in conveyed on the conveying belt 19. Specifically, the second bias application circuit 200B applies 12, 10, 13, and 13 μA as transfer current to the transfer rollers 20 corresponding to the process units 9 (K, Y, M, and C), respectively. The toner image on the photosensitive drum 10 is attracted to the conveying belt 19 by the transfer current and is transferred on the sheet P.

The toner remaining on the photosensitive drum 10 after the toner image has been transferred to the sheet P is removed from the photosensitive drum 10 to the holding roller 13 by electrostatic force when the remaining toner is in confrontation with the holding roller 13. In other words, in the image forming operation, the second bias application circuit 200B applies a collecting bias for removing the remaining toner on the photosensitive drum 10 to each of the holding rollers 13, and the remaining toner removed to the holding roller 13 is accumulated on the circumferential surface of the holding roller 13 by electrostatic attraction. Specifically, the holding roller 13 collects and holds the remaining toner deposited on the photosensitive drum 10 while the collecting bias of −500 V is applied to the holding roller 13 as shown in FIG. 3.

In this way, the sheet P having the toner image transferred from each process unit 9 leaves the conveying belt 19 and is furthermore conveyed to the fixing unit 27 provided at the downstream side in the sheet conveying direction. The fixing unit 27 fixes the toner image transferred on the sheet P to the sheet P by applying heat and pressure. The sheet P conveyed from the fixing part 27 is conveyed to the further downstream side to be ejected to the outside of the main body casing 2, and the image forming operation is finished.

After the image forming operation is finished, a toner collecting operation is performed. In the toner collecting operation, the cleaning unit 21 collects the toner held on the holding roller 13. Specifically, the second bias application circuit 200B applies a discharge bias having a polarity opposite to that of the collecting bias to each of the holding rollers 13. The toner held on the holding roller 13 is discharged and transferred to the photosensitive drum 10. Specifically, the discharge bias of +500 V is applied to the holding roller 13.

The toner transferred to the photosensitive drum 10 is transferred to the conveying belt 19 when the toner on the photosensitive drum 10 is in confrontation with the conveying belt 19. At this time, the second bias application circuit 200B applies current to the transfer roller 20. This current (the transfer current) has the same value as current applied to the transfer roller 20 in the image forming operation.

By the circularly movement of the conveying belt 19, the remaining toner transferred to the conveying belt 19 is collected to the first collecting roller 22 having a lower potential at a position where the conveying belt 19 contacts the first collecting roller 22. Specifically, the first bias application circuit 200A sets a bias applied to the first collecting roller 22 to −1000V lower than the surface potential of the conveying belt 19, and a bias applied to the second collecting roller 23 to −1400V.

Then, the remaining toner held on the first collecting roller 22 is transfer to the second collecting roller 23 having a potential lower than the first collecting roller 22. The toner collected on the second collecting roller 23 is scraped by the urethane blade 24 to be retained as waste toner in the retaining part 25.

Filming Polish Operation

Next, a polish operation will be described with reference to FIGS. 3 through 6. In the polish operation, the conveying belt 19 is polished by the toner supplied from the developing device 12. Note that, in this embodiment, the image forming operation is sequentially performed for the plurality of sheets, and the polish operation is performed in the image forming operation for one sheet of paper. As shown in FIG. 3, the polish operation is performed while the image forming operation is performed on a second sheet P.

Figure 4:
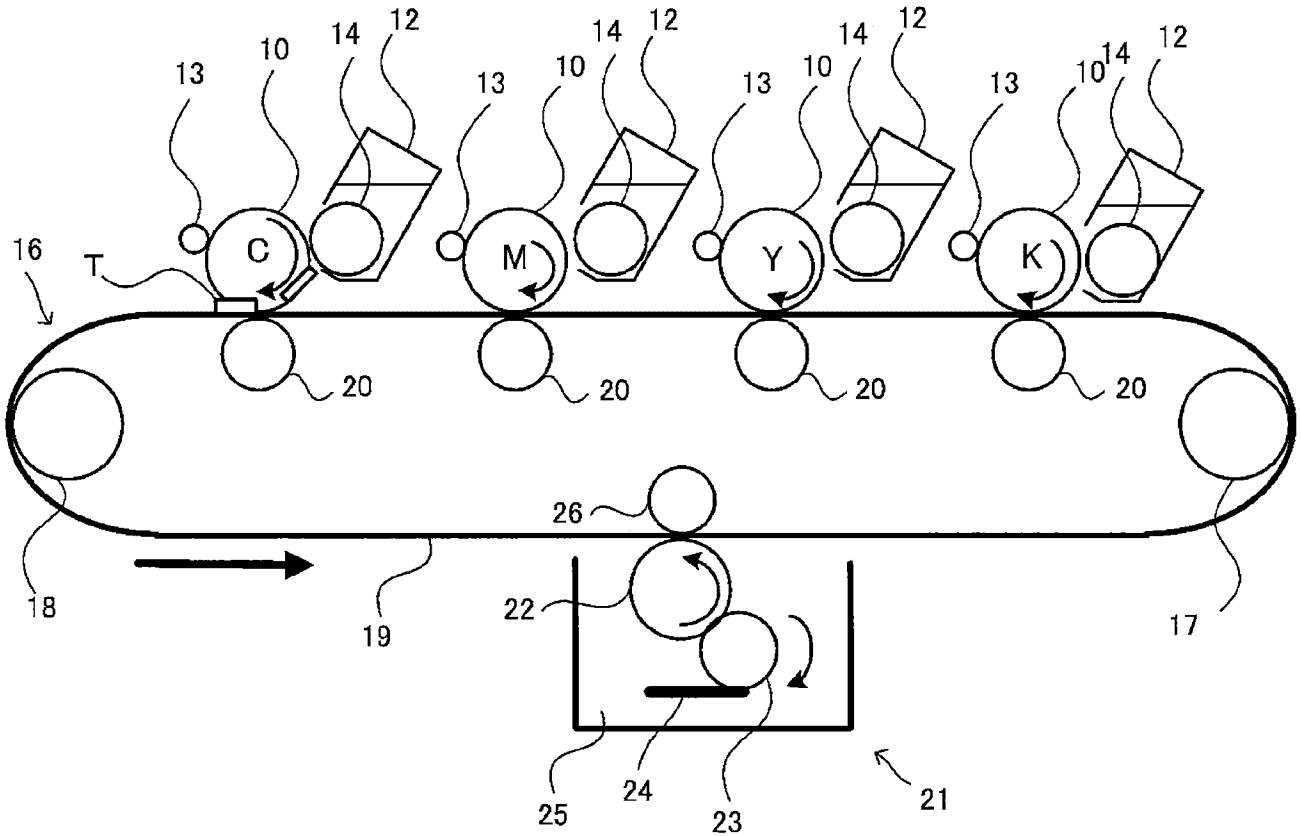
FIG. 4 is a view showing a state that a toner for the polish operation is transferred from a cyan process unit to a conveying belt.

When the polish operation starts, a toner T is supplied to the photosensitive drum 10 from the developing device 12 of the cyan process unit 9C positioned at the most downstream side in a moving direction of the upper section of the conveying belt 19 as shown in FIG. 4. Specifically, the second bias application circuit 200B applies 450V to the developing roller 14 of the cyan process unit 9C. The toner T on the developing roller 14 selectively moves onto the photosensitive drum 10 by a potential difference between the photosensitive drum 10 and the developing roller 14.

The toner T is supplied throughout the whole of an image forming region in an axial direction of the photosensitive drum 10 (the toner T develops the electrostatic latent image into the toner image), and transferred to the conveying belt 19 by contacting the conveying belt 19. This operation for transferring the toner T from the photosensitive drum 10 to the conveying belt 19 is referred to as a transfer operation. This developing and transfer operation of the cyan process unit 9C and the conveying belt 19 is performed during a sheet interval described later.

Figure 3:
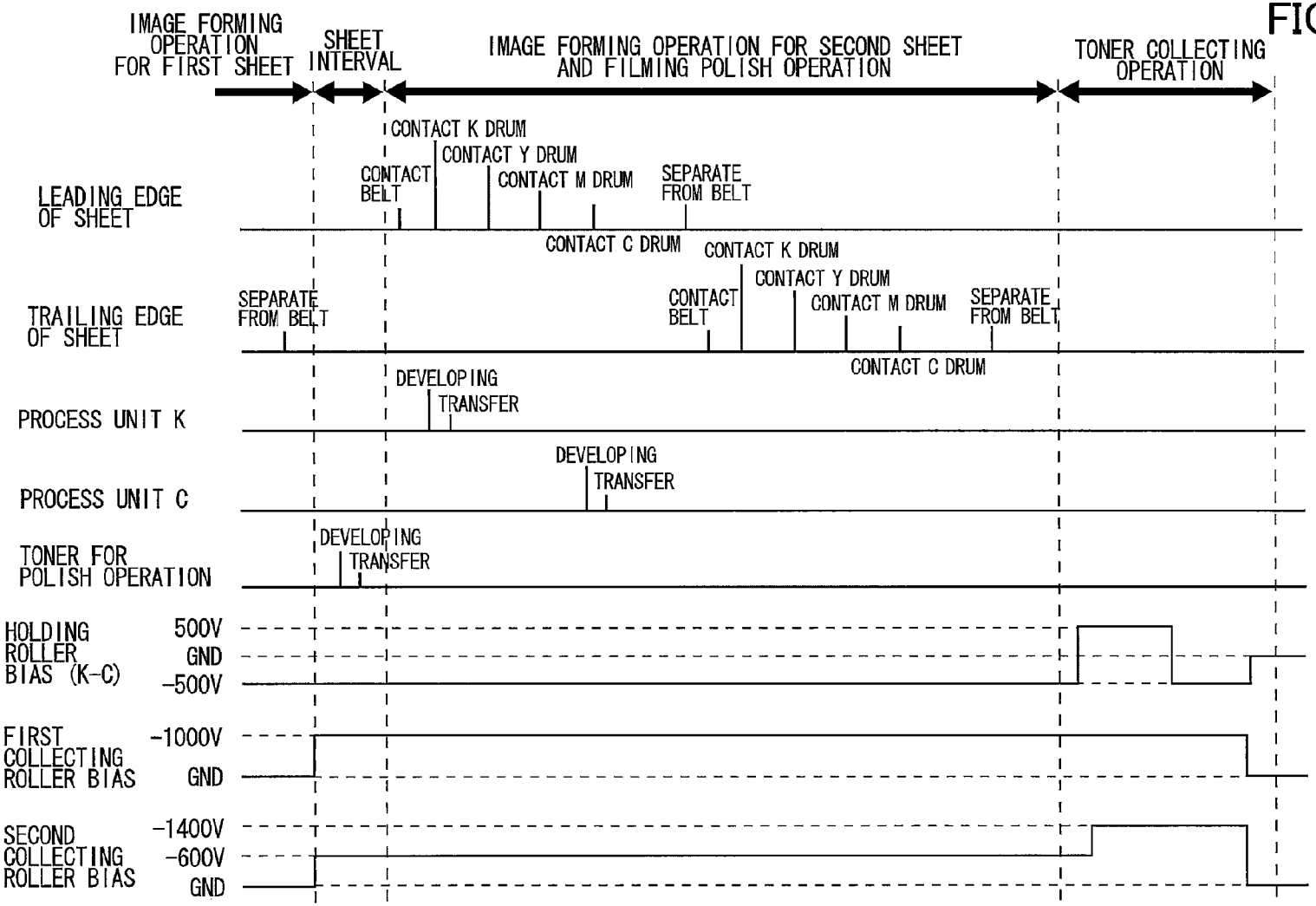
FIG. 3 is a timing chart of an image forming operation and a filming polish operation according to the embodiment of the present invention.

On the other hand, −1000V is applied to the first collecting roller 22, and −600V is applied to the second collecting roller 23 as shown in FIG. 3. In other words, when the polish operation starts, the first bias application circuit 200A applies the bias voltage to the second collecting roller 23 such that the relationship between the voltage of the first collecting roller 22 and the voltage of the second collecting roller 23 in the polish operation is opposite to that in the toner collecting operation. Thereby, the toner T collected on the first collecting roller 22 is inhibited from being transferred to the second collecting roller 23.

Figure 5:
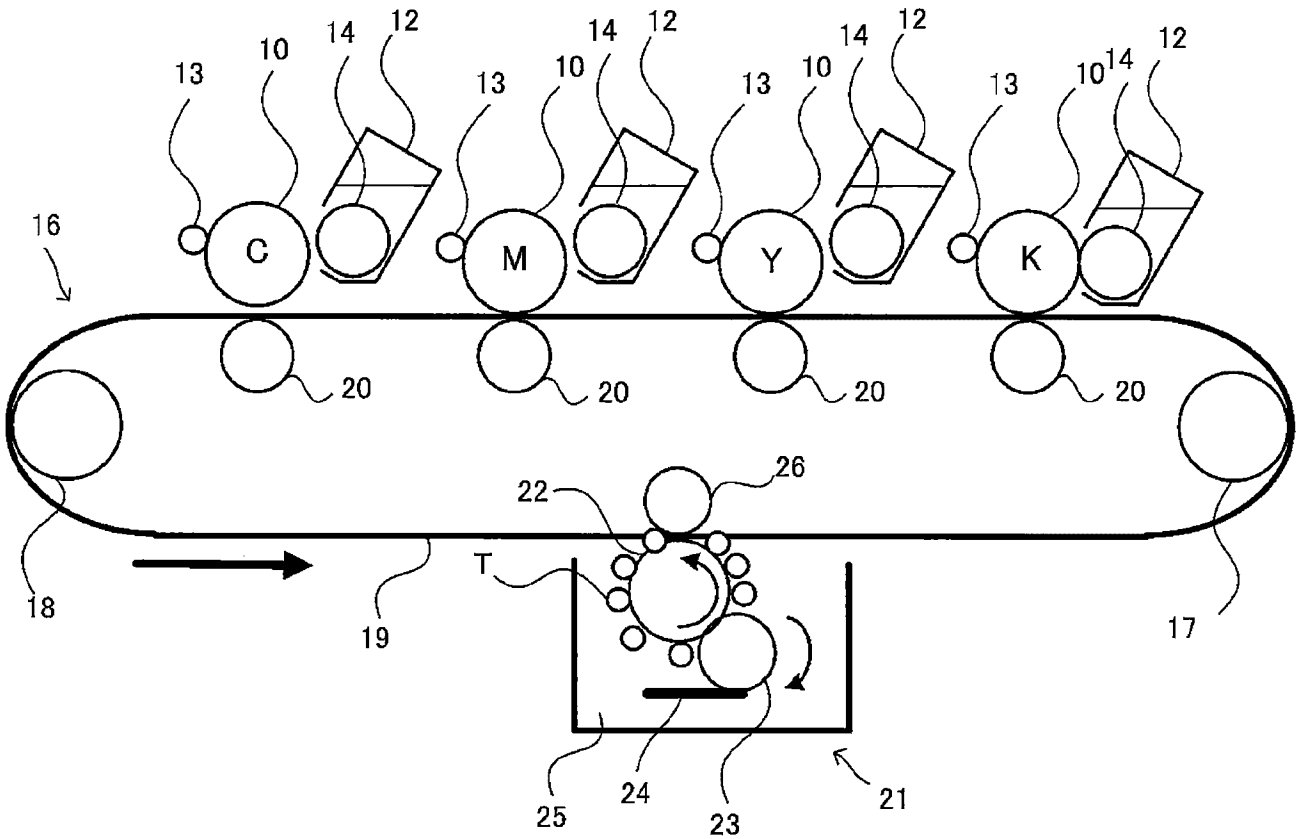
FIG. 5 is a view showing a state that the toner held on a first collecting roller polishes the conveying belt in the polish operation.

By applying the above bias voltage to each of the collecting rollers 22 and 23, the toner T collected from the conveyance belt 19 to the first collecting roller 22 is not collected (transferred) to the second collecting roller 23 but is held on the first collecting roller 22 as shown in FIG. 5. The first collecting roller 22 moves in a direction opposite to the moving direction of the lower section of the conveying belt 19 at a position where the first collecting roller 22 contacts the conveying belt 19. The first collecting roller 22 rubs the surface of the conveying belt 19 with the toner T held on the first collecting roller 22 while nipping the conveying belt 19 together with the metal roller 26.

The first collecting roller 22 holding the toner T rubs the surface of the conveying belt 19 at the nipping position to polish the surface of the conveying belt 19, and eliminates the paper powder filming formed on the surface of the conveyance belt 19.

In order to perform the polish operation as described above, the control part 100 controls the first bias application circuit 200A so as to apply the bias for the polish operation to the second collecting roller 23 at a timing during the sheet interval.

The sheet interval indicates an interval between a first timing and a second timing. The first timing indicates a timing that the trailing edge of the first sheet P is passed through a confrontation position where the photosensitive drum 10 of the cyan process unit 9C positioned at the most downstream side in the sheet conveying direction is in confrontation with the conveying belt 19 after the image forming operation for the first sheet P is completed. The second timing indicates a timing that the leading edge of the second sheet P reaches the confrontation position. In FIG. 3, the sheet interval indicates an interval between a timing that the trailing edge of the first sheet P is separated from the conveying belt 19 and a timing that the leading edge of the second sheet P contacts the conveying belt 19. A conveying timing of the sheet P is detected by using such known manners that, for example, a sheet detecting sensor is provided on a sheet conveying path around the end portions of the conveying belt 19 or that the timing is calculated on the basis of the conveying speed of the sheet P.

Next, timings of starting and finishing the polish operation will be described. As shown in FIG. 3, in the case of performing the image forming operation sequentially, the first bias application circuit 200A sets to −1000V the bias voltage applied to the first collecting roller 22 and to −600V the bias voltage applied to the second collecting roller 23 as the bias voltage for the polish operation after the image forming operation for the first sheet P is finished and after the trailing edge of the first sheet P separates from the conveying belt 19.

After the bias voltages for the polish operation are applied to the first collecting roller 22 and the second collecting roller 23, the developing device 12 supplies the toner T for polishing the conveying belt 19 to the photosensitive drum 10 of the cyan process unit 9C at the timing during the sheet interval as the transfer operation. The toner T supplied to the photosensitive drum 10 is preferably supplied on the whole of the photosensitive drum 10 in the width direction thereof. The toner T supplied to the photosensitive drum 10 is furthermore transferred to the conveying belt 19 at a position where the photosensitive drum 10 is in confrontation with the conveying belt 19 by the transfer bias applied to the transfer roller 20. Note that, after the toner for polish is supplied to the surface of the photosensitive drum 10 of the cyan process unit 9C and the supplied toner is transferred to the conveying belt 19, the toner image to be transferred to the sheet P is developed on the photosensitive drum 10.

After the toner T transferred to the conveying belt 19 in the transfer operation is transfer to the first collecting roller 22, the polish operation is performed by the first collecting roller 22. Note that, the polish operation is performed in parallel with the image forming operation. In other words, while the first collecting roller 22 and the conveying belt 19 rub each other, the image forming operation is performed for the second sheet P. This polish operation is performed preferably until at least the entire region of the surface of the conveying belt 19, in other words, at least the amount corresponding to one round of the conveying belt 19 is polished by the toner T. Obviously, the polish operation may also be performed throughout the image forming operation.

The polish operation is finished at a time when the image forming operation is finished. In more detail, in the case of performing the image forming operation for two sheets sequentially, the toner of each color (K to C) is transferred onto the sheet P, the trailing edge of the second (last) sheet P leaves the conveying belt 19, and after that, the bias voltage of −600V applied to the second collecting roller 23 is changed to the bias voltage of −1400V for the collecting operation as shown in FIG. 3.

Figure 6:
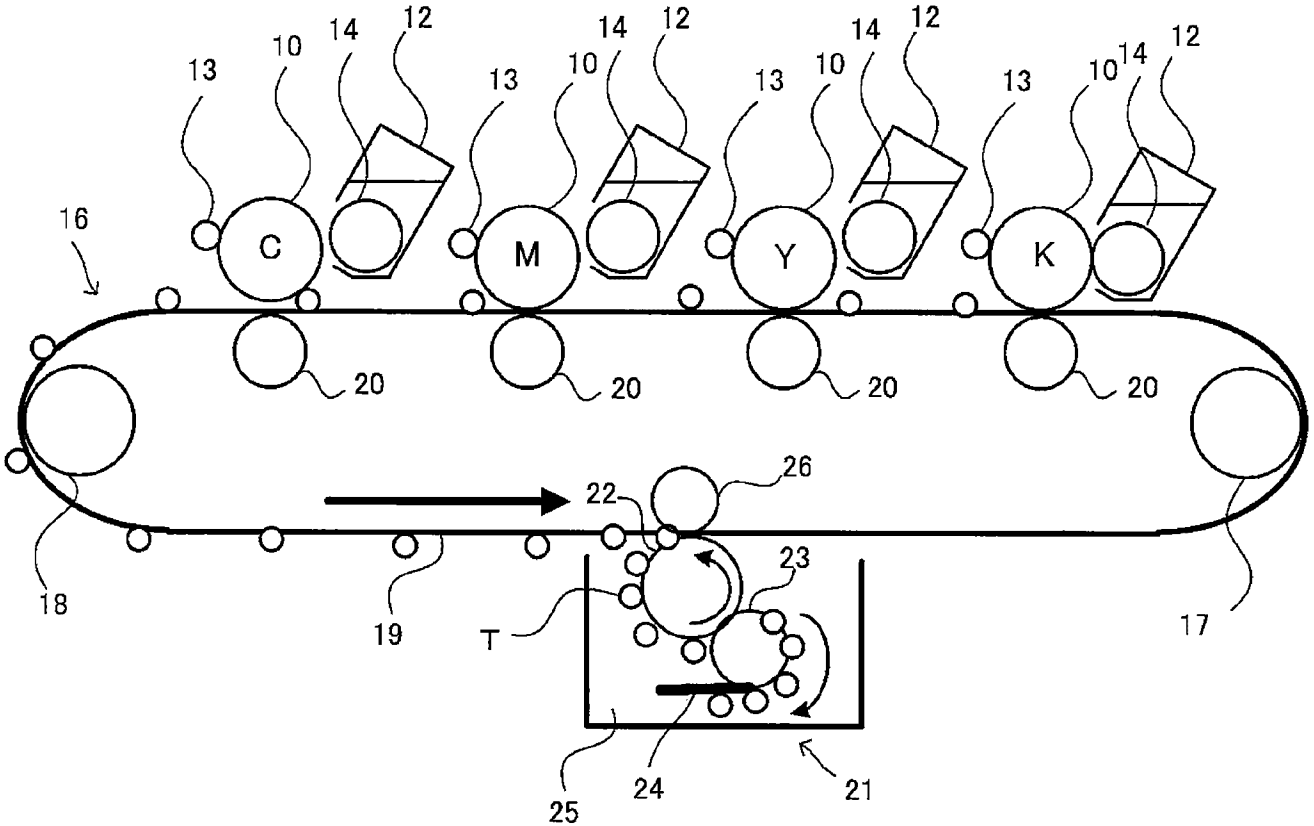
FIG. 6 is a view showing a state that a toner held on each holding roller is discharged to be collected by a cleaning unit.

Thus, at the same time as finishing the polish operation, the bias voltage applied to the holding roller 13 is changed to +500 V, and the collecting operation is started. When the collecting operation is started, the toner T held on the first collecting roller 22 in the polish operation is transferred to the second collecting roller 23 as shown in FIG. 6 and after that, is retained in the retaining part 25. Note that, when the collecting operation finishes, the color laser printer 1 is kept in a standby mode until a next image forming instruction is inputted to the control part 100. The control unit 100 may also perform the above polish operation during this standby mode. Additionally, the polish operation may also be performed by performing the transfer operation before the image forming operation for the first sheet P is performed.

As described above, since the control unit 100 controls the bias voltage for the second collecting roller 23 so as to inhibit the toner T collected on the first collecting roller 22 from being transferred to the second collecting roller 23 and the conveying belt 19 is rubbed with the toner T on the first collecting roller 22, the surface of the conveying belt 19 is polished by the toner. T Thereby, the filming of the paper powder formed on the surface of the conveyance belt 19 can be properly eliminated.

Further, since the control unit 100 controls the toner T so as to be transferred from the photosensitive drum 10 to the conveying belt 19, the toner T for rubbing the conveying belt 19 can be supplied to the first collecting roller 22. Particularly, in this embodiment, since the toner T is supplied from the developing device 12 of the image forming unit 4 to the first collecting roller 22, any specific supply source of the toner T for eliminating the paper powder filming does not need to be provided. Therefore, without complicating the entire configuration of the apparatus, the paper powder filming can be eliminated.

Further, since the transfer operation is performed by the photosensitive drum 10 of the cyan process unit 9C before the sheet P passes (reaches) a position where the photosensitive drum 10 of the cyan process unit 9C in which the toner image has been formed is in confrontation with the conveying belt 19, the polish operation can be performed while the image forming operation is performed on the sheet P. Particularly, since the transfer operation is performed during the sheet interval, the sheet interval can be effectively utilized. Hence, time loss due to the polish operation in the image forming operation can be reduced to the minimum. Moreover, since the polish operation is performed in parallel with the image forming operation, a waste of time does not arise in the image forming operation.

Further, since the toner T is supplied from the photosensitive drum 10 positioned at the most downstream side in the sheet conveying direction, the toner T transferred from the photosensitive drum 10 to the conveying belt 19 does not adhere to another photosensitive drums 10 to dirty another color photosensitive drums 10.

Further, in this embodiment, the polish operation is performed in parallel with the image forming operation, but the polish operation may be performed when the image forming operation does not executed (for example, when the color laser printer 1 is kept in the standby mode). In this case, the toner T may also be supplied from not only the developing device 12 positioned at the most downstream side in the sheet conveying direction but also another developing device 12 positioned at the upstream side of the developing device 12 of the cyan process unit 9C, or the toner T may also be supplied from the developing devices 12 for all process units 9K, 9Y, 9M, and 9C.

Another Embodiment

Next, a polish operation in accordance with another embodiment will be described with reference to FIGS. 7 and 8. Note that, only parts different from the embodiment described above will be described hereinafter, same parts and components are denoted by the same reference numerals, and detailed descriptions thereof will be omitted.

A point different from the embodiment described above is that the toner used for performing the polish operation is supplied from each of the holding rollers 13 provided in the corresponding process unit 9. Further, in this embodiment, the polish operation is performed after the image forming operation is performed for all the sheets P to be printed.

Figure 7:
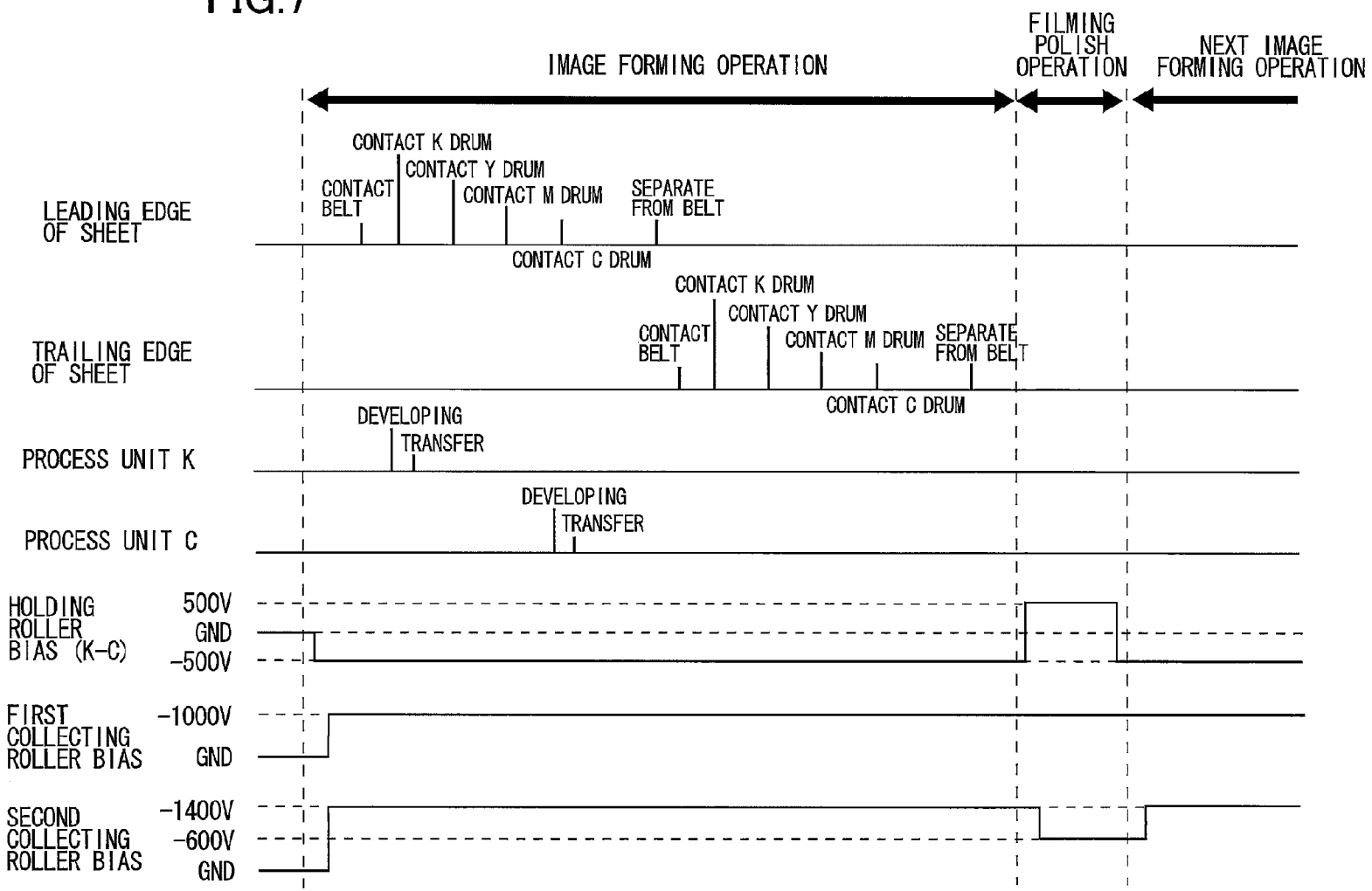
FIG. 7 is a timing chart of an image forming operation and a filming polish operation according to another embodiment of the present invention.
Figure 8:
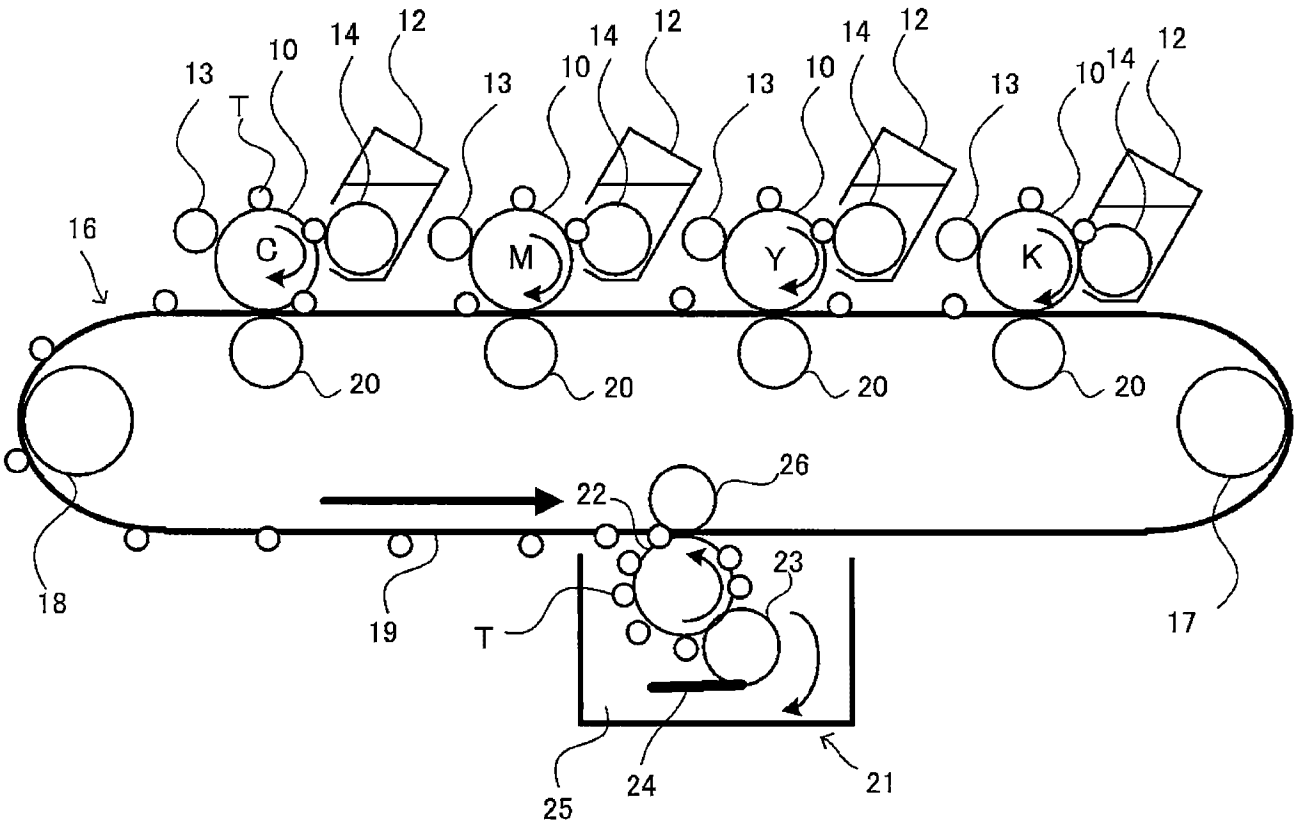
FIG. 8 is a view showing a state that a toner for the polish operation is discharged from each holding roller to be held by the first collecting roller.

As shown in FIG. 7, in the image forming operation, the collecting bias of −500V is applied to each of the holding rollers 13 so that each holding roller 13 collects the toner remaining on the photosensitive drum 10 and holds the collected toner on the surface after the toner image has been transferred to the sheet P. On the other hand, −1000V and −1400V are applied to the first collecting roller 22 and the second collecting roller 23, respectively, and the toner adhering onto the conveying belt 19 is retained in the retaining portion 25 through the first collecting roller 22 and the second collecting roller 23.

When it is determined that the image forming operation is completed after the trailing edge of the sheet P leaves the conveying belt 19, the second bias application circuit 200B applies to the holding roller 13 of each process unit 9 the discharge bias of +500V for transferring (discharging) the toner to the photosensitive drum 10 as the transfer operation. The toner on the holding roller 13 is transferred to each of the photosensitive drums 10 and is furthermore transferred to the conveying belt 19 by the transfer bias.

On the other hand, at the same time as changing the bias voltage applied to the holding roller 13 for the transfer operation as described above, the bias voltage applied to the second collecting roller 23 is set to −600V from −1400V. Thereby, since the second collecting roller 23 has the bias voltage (−600V) higher than the first collecting roller 22 (−1000V), the toner transferred from the conveying belt 19 to the first collecting roller 22 is inhibited from being transferred to the second collecting roller 23 and is held on the first collecting roller 22 as shown in FIG. 8. The first collecting roller 22 holding the toner rubs the conveying belt 19 to thereby polish the paper powder filming. The polish operation is continuously performed until the next image forming operation starts. However, the polish operation may be finished at a time that the conveying belt 19 goes one round.

When the circumferential surface corresponding to one round of the conveying belt 19 has been polished, the control unit 100 controls the first bias application circuit 200A so as to finish the polish operation. Specifically, the first bias application circuit 200A sets to −1400V the bias voltage applied to the second collecting roller 23, and controls the toner on the first collecting roller 22 so as to transfer the toner to the second collecting roller side 23. The toner transferred to the second collecting roller 23 is scraped by the urethane blade 24 to be retained as waste toner in the retaining portion 25. On the other hand, the bias voltage applied to the holding roller 13 is set to −500V by the second bias application circuit 200B such that the holding roller 13 collects the remaining toner on the photosensitive drum 10 and holds the collected remaining toner.

In this way, the color laser printer 1 in this embodiment is controlled such that the toner held on the holding roller 13 is transferred to the first collecting roller 22 through the conveying belt 19 to polish the surface of the conveying belt 19. Therefore, the next image forming operation can be performed in a state that the paper powder filming is eliminated. Further, since the toner temporarily collected from the surface of the photosensitive drum 10 is used for the polish operation, the new toner for the polish operation does not need to be supplied. Accordingly, it is economical on the color laser printer 1.

Since the transfer operation is performed after finishing the image forming operation, the transfer operation does not interfere with the image forming operation. Further, since the polish operation is performed by using the toner discharged from the holding roller 13 to the photosensitive drum 10, the transfer operation can be incorporated into a part of time for performing the collecting operation.

Note that, the toner is discharged from all the holding rollers 13 in the polish operation in this embodiment, but as described above, the toner may also be supplied from only the holding roller 13 provided in the cyan process unit 9C located at the most downstream side in the sheet conveying direction. Additionally, the control unit 100 may control the first bias application circuit 200A to supply the bias voltage to each of the collecting rollers 22 and 23. Further, the transfer operation may be performed by supplying the toner from both the holding roller 13 and the developing device 12.

Experimental Example

The experimental example about the above-described embodiments will be described below with reference to FIG. 9. In this experimental example, a change in the gloss of the surface of the conveying belt with the polish operation and without the polish operation is evaluated.

Now, conditions for an evaluation experiment of the gloss level will be described. HL-4050 produced by Brother Industries, Ltd. was used as the laser printer. The conveying belt was a nylon resin belt. The used toner mainly includes styrene-acrylic non-magnetic single-component toner. Additionally, the experiment was performed under environment at a temperature of 10° C. and a relative humidity (RH) of 20%.

The evaluation on a change in the gloss of the surface of the conveying belt was conducted as follows. First, the gloss of the surface of the conveying belt is measured before the conveying belt conveys the sheet (no sheet is conveyed by the conveying belt.). After that, ten thousand sheets are conveyed by the conveying belt, and thereafter the gloss is measured. After the conveying belt conveys the sheets, the surface of the conveying belt is covered with the paper powder. Hence, the gloss level of the conveying belt is reduced. Thus, the more the gloss level on the surface of the conveying belt changes between before and after conveying the sheets, the more the belt filming is formed.

The gloss level after conveying the sheets was evaluated immediately after conveying ten thousand sheets and immediately after performing the above-described polish operation for the conveying belt while ten thousand sheets are conveyed. Note that, GLOSS CHECKER IG-320 produced by HORIBA was used as an evaluation instrument for measuring the gloss level of the conveying belt, and the gloss level was measured twice under each of the conditions. The value of the gloss level is an average value of when the gloss level is measured at four positions in the circumferential direction of the conveying belt with the gloss checker.

Figure 9:
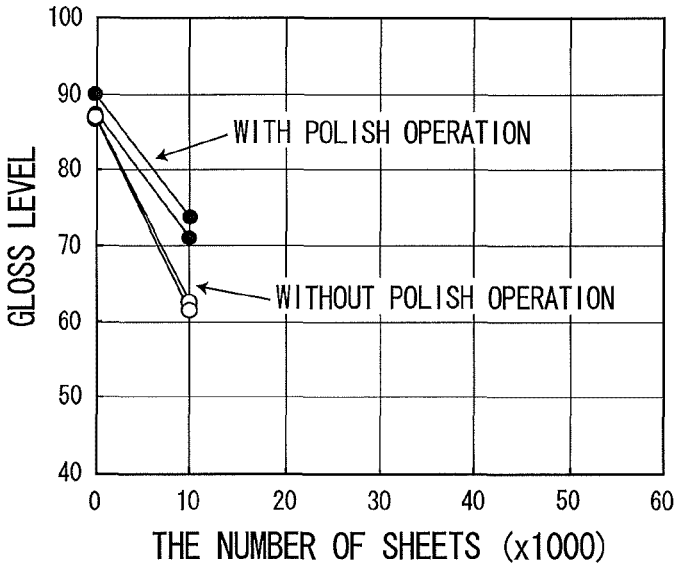
FIG. 9 is a graph showing a change in a gloss of the conveying belt between before and after conveying a number of sheets.

FIG. 9 shows the result of the experiment. The gloss level of the conveying belt is found to be deteriorated between before and after conveying ten thousand sheets. This is caused by coating the conveying belt with the paper powder. On the other hand, in comparison with the conveying belt without the polish operation, the gloss level of the conveying belt with the polish operation is inhibited from being deteriorated. Thus, as a result of polishing the belt with the toner, the paper powder filming on the belt can be eliminated to recover the gloss level.

What is claimed is:

1. An image forming apparatus comprising:

an endless belt circularly moving to convey a recording medium placed thereon in a conveying direction;

a plurality of photosensitive bodies juxtaposed in the conveying direction with confronting the endless belt;

a plurality of process units supplying developer to the plurality of photosensitive bodies to form a developer image thereon, respectively;

a first collecting member contacting the endless belt to collect the developer on the endless belt;

a second collecting member capable of collecting from the first collecting member the developer collected on the first collecting member;

a control unit applying a bias between the first collecting member and the second collecting member to inhibit the developer collected on the first collecting member from being transferred to the second collecting member when the first collecting member rubs the endless belt with the toner collected on the first collecting member.

2. The image forming device according to claim 1, further comprising a first bias application unit, a second bias application unit, and a plurality of transfer rollers each positioned in confrontation with each photosensitive body interposing the endless belt therebetween, and wherein the control unit controls the first bias application unit to apply the bias to the first collecting member and the second collecting member, and controls the second bias application unit to apply a transfer bias to at least one of the plurality of transfer rollers for a transfer operation, the developer on at least one of the plurality of photosensitive bodies corresponding to the at least one of the plurality of transfer rollers being transferred to the endless belt in the transfer operation.

3. The image forming device according to claim 2, further comprising a plurality of holding units each corresponding to each photosensitive body to collect and hold the developer deposited on the corresponding photosensitive body, and wherein the control unit controls the second bias application unit to apply a bias to the plurality of holding units to transfer the developer held by each of the plurality of holding units to the corresponding photosensitive body, the developer transferred to each of the plurality of photosensitive bodies being transferred to the endless belt in the transfer operation.

4. The image forming device according to claim 2, wherein, when the control unit receives image data, an image forming operation for forming an image corresponding to the image data on the recording medium is performed by using the endless belt, the plurality of photosensitive bodies, and the plurality of process units, and wherein the control unit executes the transfer operation between a completion of the image forming operation and an initiation of a next image forming operation.

5. The image forming device according to claim 2, the control unit controls the second bias application unit to apply a bias to at least one of the plurality of process units such that the developer of the at least one of the plurality of process units is transferred to the at least one of the plurality of photosensitive bodies, the developer transferred to the at least one of the plurality of photosensitive bodies being transferred to the endless belt in the transfer operation.

6. The image forming device according to claim 5, wherein the transfer operation is performed before the recording medium reaches a position where one of the plurality of photosensitive bodies in which the developer image has been formed is in confrontation with the endless belt.

7. The image forming device according to claim 6, wherein the endless belt conveys a first recording medium and a second recording medium following the first recording medium, each of the first recording medium and the second recording medium having a leading edge and a trailing edge in the conveying direction, and wherein the transfer operation is performed between a first timing and a second timing, the first timing indicating a timing that the trailing edge of the first recording medium is passed through a confrontation position where the one of the plurality of photosensitive bodies is in confrontation with the conveying belt, the second timing indicating a timing that the leading edge of the second recording medium reaches the confrontation position.

8. The image forming device according to claim 2, wherein, when the transfer operation is performed, the developer on one of the plurality of photosensitive bodies is transferred to the endless belt, the one of the plurality of photosensitive bodies being positioned at a most downstream side in the conveying direction.

9. The image forming device according to claim 2, wherein the first collecting member is a first collecting roller having a surface and the second collecting member is a second collecting roller, and wherein the control unit controls the first bias application unit to apply a bias to the first collecting roller and the second collecting roller such that the first collecting roller collects the developer from the endless belt and holds the collected developer on the surface.

* * * * *